US005464259A

United States Patent [19]

Cohrs et al.

[11] Patent Number: 5,464,259

[45] Date of Patent: Nov. 7, 1995

[54] DOOR LATCH ASSEMBLY WITH MELTABLE FUSE MECHANISM

[75] Inventors: Richard B. Cohrs; Gerald E. Mader, both of Indianapolis, Ind.

[73] Assignee: Von Duprin, Inc., Indianapolis, Ind.

[21] Appl. No.: 70,065

[22] Filed: Jun. 1, 1993

[51] Int. Cl.[6] ..... E05B 65/10

[52] U.S. Cl. ..... 292/92; 292/DIG. 66; 70/92

[58] Field of Search ..... 70/92; 292/92, 292/DIG. 65, DIG. 66, DIG. 44

[56] References Cited

U.S. PATENT DOCUMENTS

| | | | |
|---|---|---|---|
| 3,811,717 | 5/1974 | Floyd et al. | 292/DIG. 66 X |
| 4,003,593 | 1/1977 | Wilzig et al. | 292/DIG. 66 X |
| 4,007,954 | 2/1977 | Erickson | 292/DIG. 66 X |
| 4,015,869 | 4/1977 | Horvath | 292/DIG. 66 X |
| 4,183,565 | 1/1980 | Allemann | 292/DIG. 66 X |
| 4,598,939 | 7/1986 | Krupicka et al. | 292/DIG. 66 X |
| 4,709,950 | 12/1987 | Zortman | 292/DIG. 66 X |
| 4,726,613 | 2/1988 | Foshee | 292/DIG. 66 X |
| 4,824,150 | 4/1989 | Smith et al. | 292/DIG. 66 X |
| 4,865,367 | 9/1989 | Choi | 292/DIG. 66 X |

FOREIGN PATENT DOCUMENTS

| | | | |
|---|---|---|---|
| 471112 | 2/1992 | European Pat. Off. | 292/DIG. 66 |

*Primary Examiner*—Peter M. Cuomo
*Assistant Examiner*—Suzanne L. Dino
*Attorney, Agent, or Firm*—Robert F. Palermo; A. James Richardson; Craig A. Wood

[57] ABSTRACT

A latch assembly for a fire door having a pushpad for emergency exit is described. The pushpad is connected to a rod to transfer motion of the pushpad to the latch assembly. The latch assembly includes a platform attached to the fire door, a linkage assembly attached between the rod and a latch bolt, and a deadlock arm assembly attached to the platform. The deadlock arm assembly is movable between a first position to block movement of the linkage assembly and a second position to allow movement of the linkage assembly. A fire fuse assembly is also attached to the linkage assembly to move the deadlock arm assembly out of its first position blocking movement of the linkage assembly at normal room temperature. The fire fuse assembly is configured to melt at temperatures substantially above normal room temperature to prevent engagement between the fire fuse assembly and the deadlock arm assembly, effectively preventing movement of the deadlock arm assembly out of its first position blocking movement of the linkage assembly in response to movement of the rod.

6 Claims, 5 Drawing Sheets

DOOR LATCH ASSEMBLY WITH MELTABLE FUSE MECHANISM

BACKGROUND OF THE INVENTION

The present invention relates to door latch mechanisms for holding doors in a closed position. More particularly, the present invention relates to rod linked, door latch mechanisms for fire doors.

Commercial or public buildings are typically required to provide for emergency exit in the event of a fire. One common variety of emergency exit is a latch closed double door, about eight feet high and equipped on its inside with panic bars or push pads. Pushing the panic bar or push pad toward the door releases two or more door latches, permitting opening of the door and escape of the building occupant.

For example, U.S. Pat. No. 4,974,890 to Cohrs, assigned to Von Duprin, Inc., the disclosure of which is hereby incorporated by reference, discloses a vertical rod exit device for a double door. Top and bottom latch mechanisms are connected by vertically extending rods to a push pad. Pushing the push pad toward the door causes retraction of the rods away from the latch mechanisms, and consequent release of latches holding the door in a closed position against a door frame.

However, the latch mechanism described in U.S. Pat. No. 4,974,890 may not provide a suitable latching action during sustained fires, especially if the door is over eight feet in height. Buckling and folding of the rods as a result of the intense heat of a fire can cause release of the latches holding the door closed. To overcome this problem, a mechanism for preventing disengagement of the latches due to fire is needed.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

The present invention provides a latch assembly for a fire door having a pushpad for emergency exit, with the pushpad being connected to a rod to transfer motion of the pushpad to the latch assembly; the latch assembly including a platform attached to the fire door, an input wheel rotatably connected to the platform, a rod connector attached between the rod and the input wheel to rotate the input wheel in response to movement of the rod and connected pushpad, a linkage assembly coupled to the input wheel to move a latch bolt as the input wheel is rotated, a deadlock arm assembly pivotally attached to the platform and positioned to block movement of the linkage assembly, and, attached to the linkage assembly, a fire fuse assembly to move the deadlock arm assembly out of position to block movement of the linkage assembly, with the fire fuse assembly being configured to melt at temperatures substantially above normal room temperature to prevent movement of the deadlock arm out of a position blocking movement of the linkage assembly.

The foregoing and other aspects will become apparent from the following detailed description of the invention when considered in conjunction with the accompanying drawing figures.

DETAILED DESCRIPTION

Figure 1:
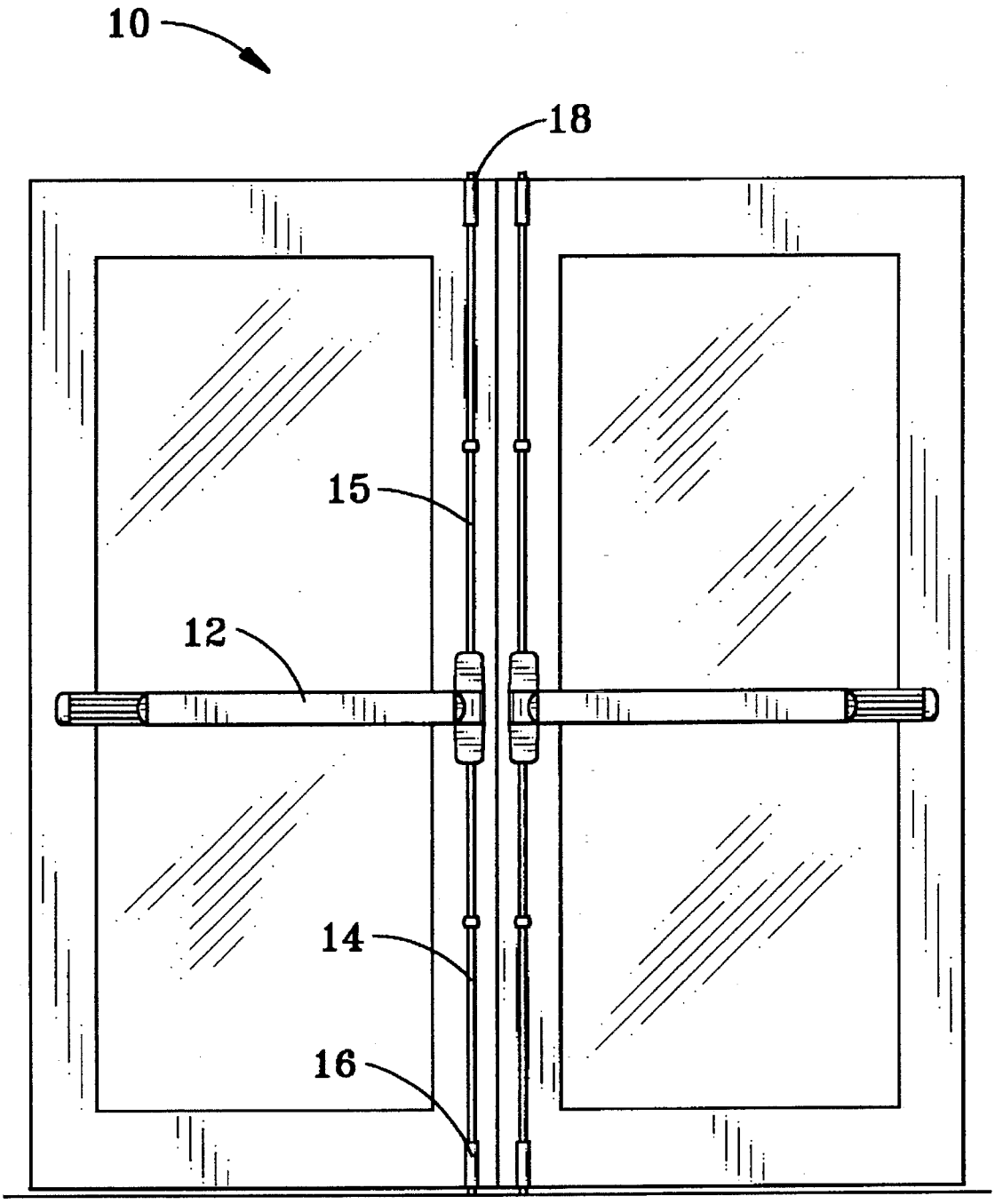
FIG. 1 is a frontal view of a dual fire door, with each door having a pushpad operated panic exit that moves upwardly and downwardly directed vertically extending rods to operate retraction of respective top and bottom latch assemblies.
Figure 2:
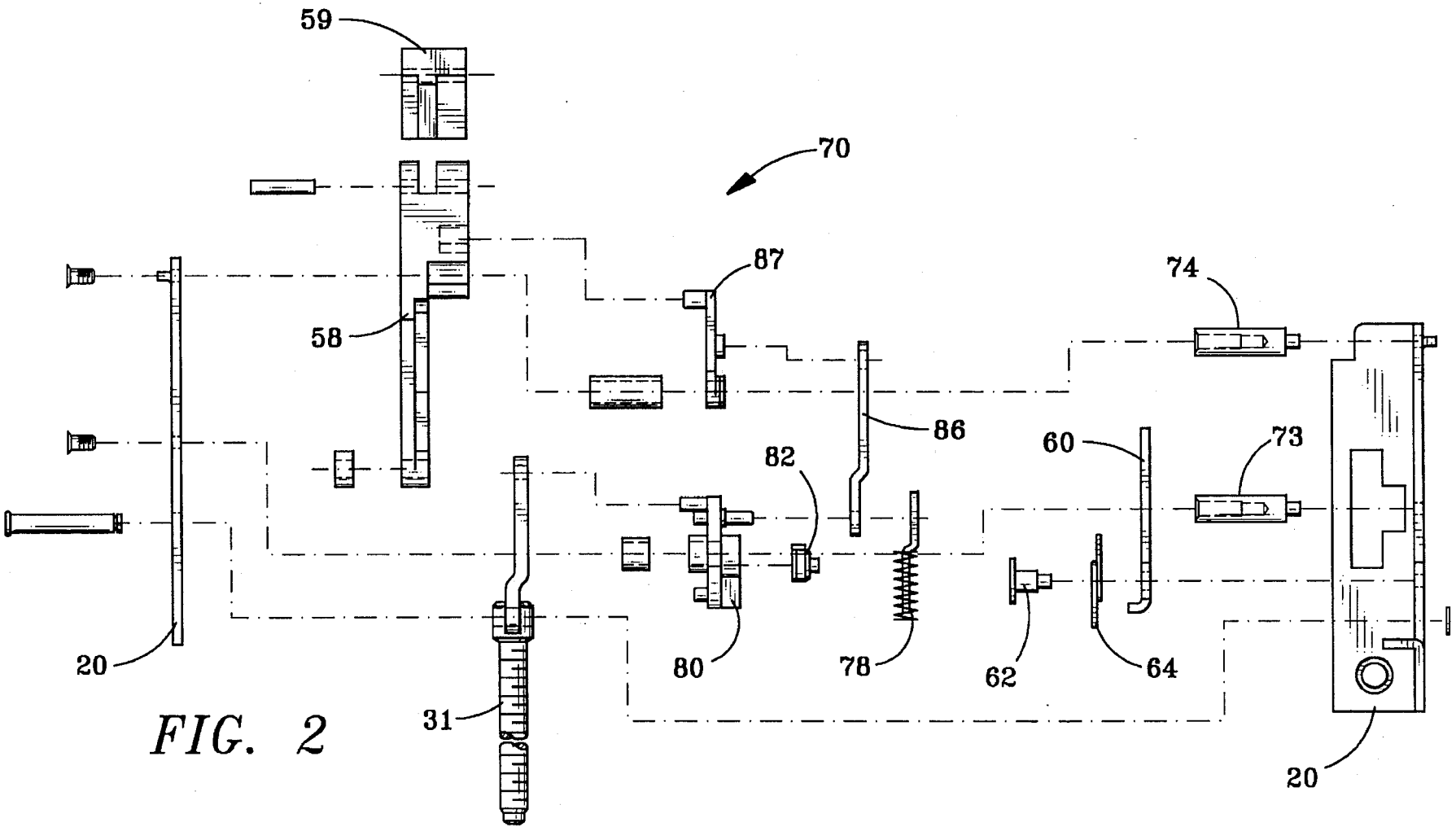
FIG. 2 is an exploded view illustrating components of a bottom latch assembly.
Figure 3:
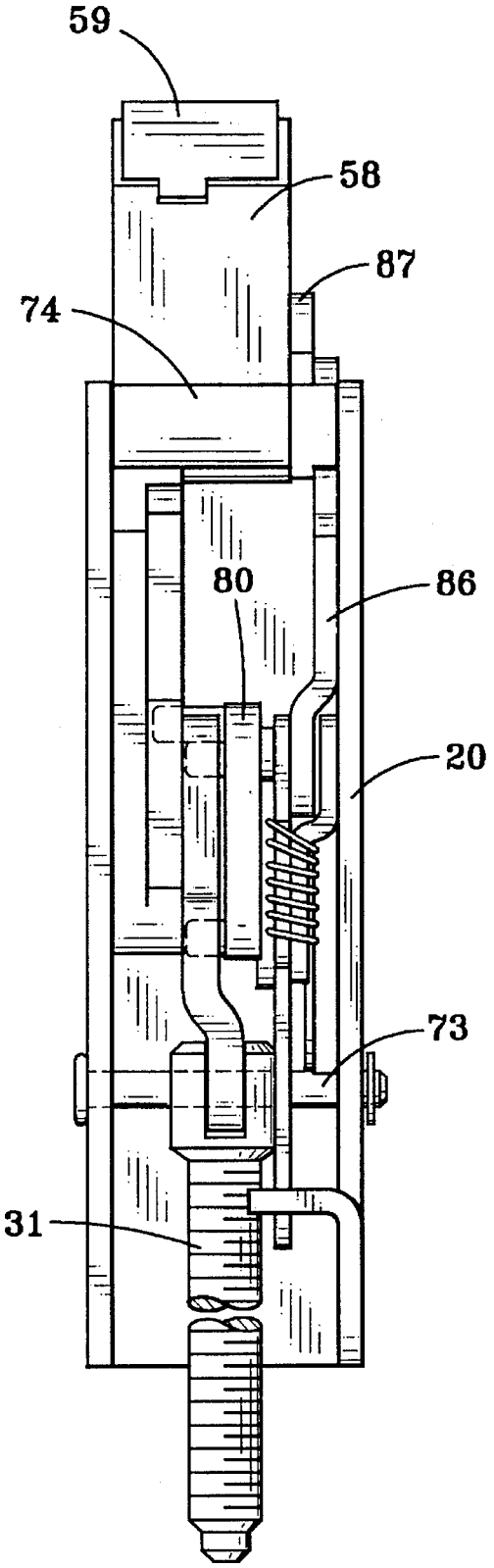
FIG. 3 is a schematic top view of an assembled bottom latch assembly.
Figure 4:
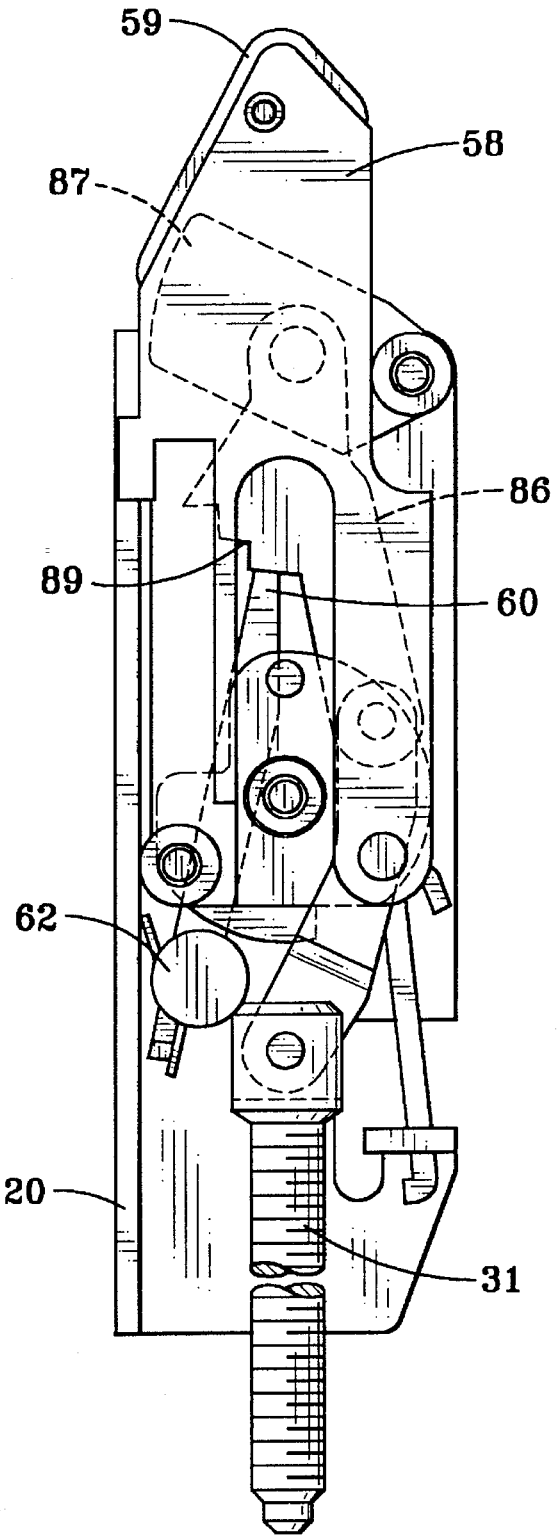
FIG. 4 is a schematic side view of an assembled bottom latch assembly, with a portion of a housing platform broken away to reveal movable elements, and phantom lines indicating other components for clarity.
Figure 5:
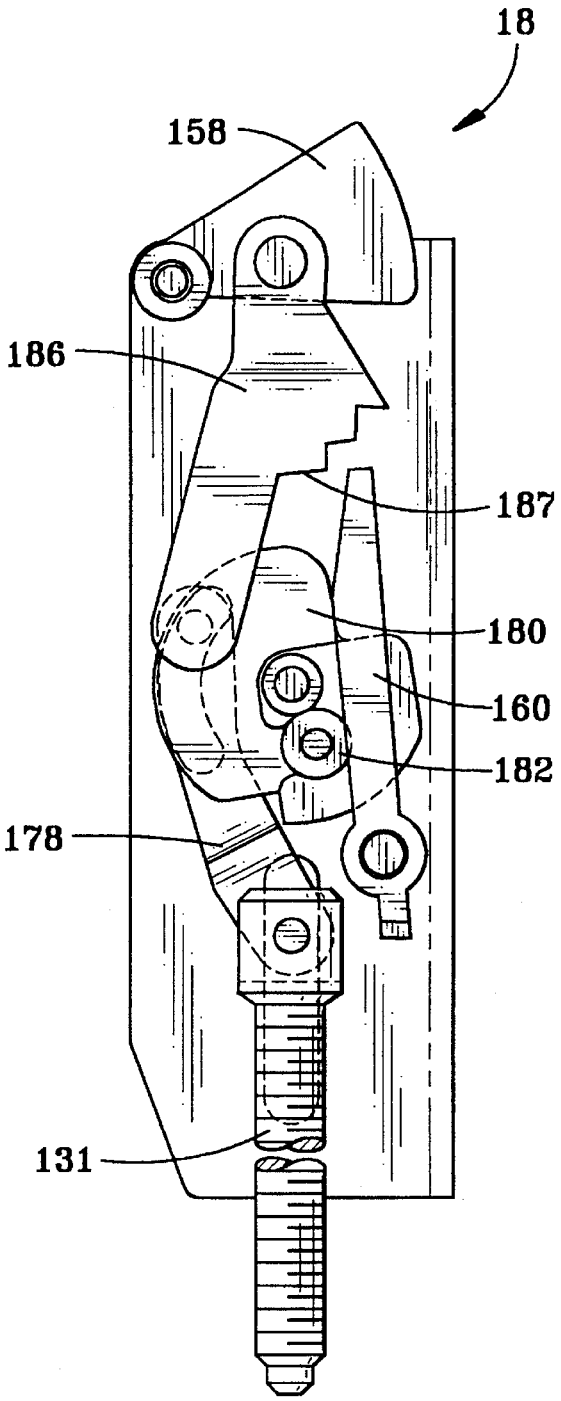
FIG. 5 is a schematic side view of an assembled top latch assembly with the latch bolt extended.
Figure 6:
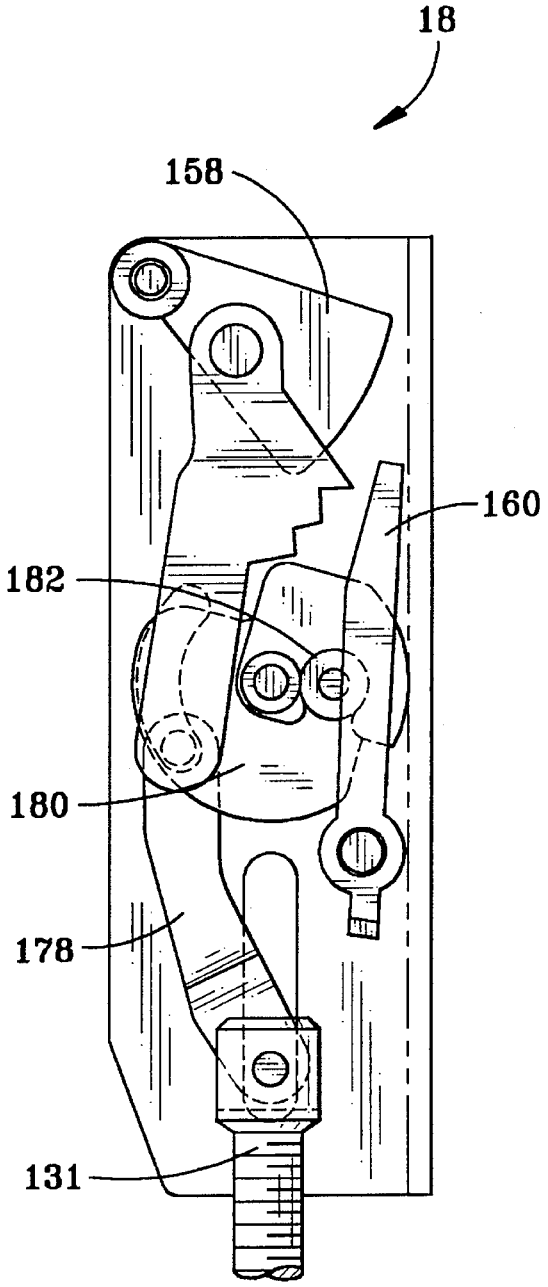
FIG. 6 is a schematic side view of the top latch assembly of FIG. 5 with its rod connector pulled downward to permit simultaneous movement of a deadlock arm away from a latch bolt linkage assembly and retraction of the latch bolt.
Figure 7:
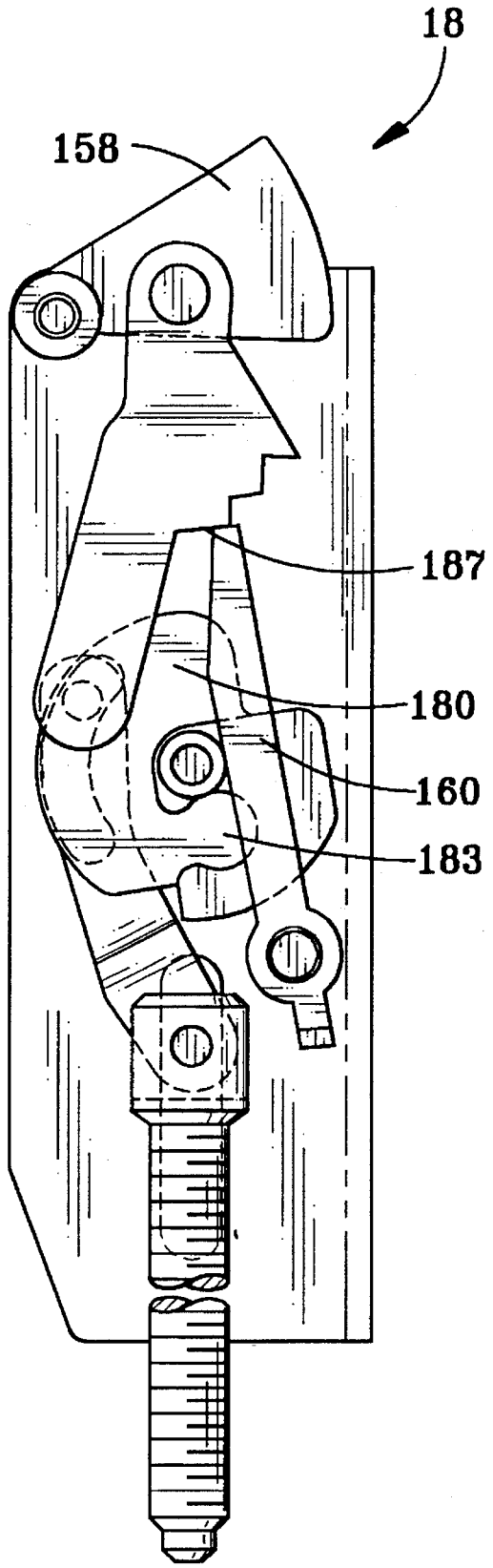
FIG. 7 is a schematic side view of the top latch assembly of FIGS. 7 and 8 with its fire fuse assembly melted so that a deadlock arm is not moved away by heat induced rod movement.

As shown in FIG. 1, a dual fire door 10 includes two hinge mounted fire doors. Each fire door is equipped with a pushpad 12 that is depressed toward the door 10 to enable opening of the door and rapid exit from a building. The door 10 has both a top latch assembly 18 and a bottom latch assembly 16. Vertically extending and upwardly directed metal rods 15 connect the pushpad 12 to the top latch assembly 18. Similarly, vertically extending and downwardly directed metal rods 14 connect the pushpad 12 to the bottom latch assembly 16. Movement of the rods 14, 15 toward the pushpad 12, whether intentionally caused by an operator pushing the pushpad or by a fire bending and warping the rods, causes latch bolts in the respective latch assemblies 18 and 16 to retract, and allowing the door 10 to open, To prevent inadvertent, fire induced opening of the latch assemblies, a bottom latch assembly such as illustrated in FIGS. 2, 3, and 4 or a top latch assembly such as illustrated in FIGS. 5, 6, and 7 is employed. The key element for functioning is a fire fuse such as illustrated in detail in FIG. 8. High temperatures cause melting of a fire fuse, inactivating portions of the mechanism of the latch assemblies 16 and 18 that normally (at room temperature) would allow retraction of a latch bolt when a rod is pulled away from the latch assembly toward the pushpad.

FIG. 2 is an exploded view of bottom latch assembly 16. The latch assembly 16 includes a platform 20 that supports internal moving mechanisms by provision of shafts 74 and 73. In operation, the platform 20 is permanently installed to fit into a fire door 10. Installation can involve keying emplacement, bolt attachment, permanent blocks, or any other conventional attachment mechanism. The illustrated mechanism is similar to that shown in U.S. Pat. No. 4,974,890, with the notable exception of an added fire fuse 82.

As seen in FIG. 2, 3, and 4, components of the bottom latch assembly 16 include a rod connector 31 (normally attached to a rod not shown) that can move toward or away from the latch assembly 16. The rod connector 31 is connected to a rotatable input wheel 80, which is in turn connected to latch bolt 58 by a link assembly 70. The link assembly 70 includes an output link 87 and a latch bolt link 86 configured to have a land 89. The latch bolt 58 (and its durable latch bolt insert 59) are therefore extended by a series of events that include movement of link assembly 70 caused by rotating input wheel 80 and movement of the rod connector 31 toward the assembly 16 to cause extension of the latch bolt 58 (note that inward pushing of input link 78, which is attached to latch bolt link 86, causes extension). A reverse chain of mechanism movement causes the latch bolt 58 to be retracted when the rod connector 31 is moved away from the assembly 16.

However, a deadlock arm 60 is provided to impede movement of latch bolt 58. The deadlock arm 60 is attached for pivotal movement by a rivet 62 to the platform 20. The deadlock arm 60 is further attached to a torsion spring 64 to bias the deadlock arm 60 toward engagement with land 89 of the output link 87.

The deadlock arm 60 must be moved from its normally spring biased first position to a second position before retraction of the latch bolt 58 is permitted. Normally, this automatically occurs because action of the fire fuse 82, attached for rotating movement to the input wheel 80, sweeps around to push the deadlock arm 60 out of its blocking position to a second, non-blocking position. If the fire fuse is not present because of melting, there is no mechanism to sweep the deadlock arm 60 to its second position. The deadlock arm 60 is left engaged with land 89 of the latch bolt link 86, preventing retraction of the latch bolt 58.

The relative positions of a deadlock arm and latch bolt link are best seen in FIGS. 5, 6, and 7, which schematically illustrate side views of a top latch assembly 18. FIG. 5 illustrates assembly 18 having latch bolt 158 connected by latch bolt link 186 to input wheel 180 (an incidentally to input link 178), which in turn is connected to rod connector 131. Movement of a pivotally mounted deadlock arm 160 is encouraged by a rotating fire fuse 182, mounted in a cavity 183 defined in the input wheel 180. In a manner substantially the same as that previously discussed in relation to bottom latch assembly 16, outward movement of the rod connector 131 causes the fire fuse 182 to move to the position shown in FIG. 6, pressing the deadlock arm 160 away from its first position for engaging land 187 of latch bolt link 186, to a second position that allows retraction of the latch bolt 158.

However, as illustrated in FIG. 7, if the fire fuse 182 is destroyed by melting to leave only cavity 183, rotation of the input wheel 180 does not result in engagement of an element with the deadlock arm 160. The deadlock arm 160 remains in its spring biased first position, solidly engaged with the land 187 to prevent undesired retraction of the latch bolt 158.

Figure 8:
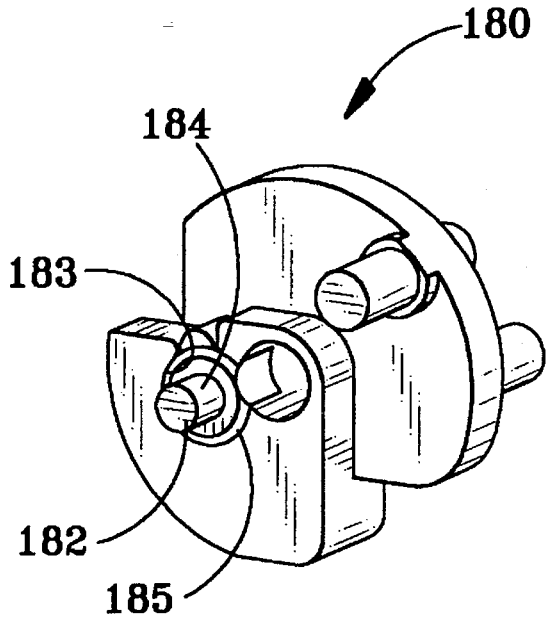
FIG. 8 is a close up view of a fire fuse pin set in a meltable zinc cylinder positioned in an input wheel.

As shown in FIG. 8, a meltable fuse can be constructed by combination of a cylindrical pin 184, typically formed from steel or other wear resistant material, and a softer, easily melted shell that supports the pin 184 in a cavity 183 defined in the input wheel 180. The meltable shell can be formed from zinc, zinc alloys, or other low temperature meltable elements that ordinarily have sufficient structural strength at room temperature to support a pin. A typical melting temperature can be selected to be about 400 degrees Celsius, although other temperatures can be selected as needed. Of course, as those skilled in the art will appreciate, construction of a meltable fuse encompasses monoblock or multiple component embodiments, although the two piece fuse (steel pin plus zinc shell) disclosed is often preferable because of ease of construction and low cost.

While the present invention has been described in connection with certain specific embodiments, it should be understood that the specific examples are not intended to limit the invention as set forth in the following claims.

What is claimed is:

1. A latch assembly for a fire door, the fire door having a pushpad for emergency exit, with the pushpad being connected to an extended rod to transfer motion of the pushpad to the latch assembly, the latch assembly comprising:

a platform attached to the fire door;

an input wheel rotatably connected to the platform;

a rod connector attached between the rod and the input wheel to rotate the input wheel in response to movement of the rod and connected pushpad;

a linkage assembly coupled to the input wheel to move a latch bolt as the input wheel is rotated;

a deadlock arm assembly pivotally attached to the platform and positioned to block movement of the linkage assembly; and a fire fuse assembly attached to the linkage assembly to move the deadlock arm assembly out of position to block movement of the linkage assembly, with the fire fuse assembly configured to melt at temperatures substantially above normal room temperature to prevent movement of the deadlock arm out of a position blocking movement of the linkage assembly, the fire fuse assembly having a pin partially disposed within a meltable element, the meltable element connected to the input wheel for rotating movement of the pin and the meltable element with the input wheel, with the pin being positioned to engage and move the deadlock arm assembly as the pin is rotated to prevent blocking obstruction of the linkage assembly by the deadlock arm assembly.

2. The latch assembly of claim 1, wherein the pin is formed from wear resistant steel and the meltable element is formed from low melting temperature zinc, with the zinc configured to melt at a temperature of about 400 degrees Celsius, present during fires, and prevent movement of the deadlock arm assembly.

3. A latch assembly for a fire door having a rod movable to control latch bolt action, the latch assembly comprising:

a platform attached to the fire door;

an input wheel rotatably connected to the platform;

means for connecting the rod and the input wheel to rotate the input wheel in response to movement of the rod;

means for moving a latch bolt coupled to the input wheel to move the latch bolt as the input wheel is rotated;

a deadlock arm assembly pivotally attached to the platform and positioned to block movement of the moving means; and a fire fuse assembly attached to the moving means to move the deadlock arm assembly out of position to block movement of the moving means, with the fire fuse assembly configured to melt at temperatures above about 400 degrees Celsius to prevent movement of the deadlock arm out of a position blocking movement of the moving means, the fire fuse assembly having a pin partially supported within a meltable element, the meltable element connected to the input wheel for rotating movement of the pin and the meltable element with the input wheel, with the pin being positioned to engage and move the deadlock arm assembly as the pin is rotated to prevent blocking obstruction of the moving means by the deadlock arm assembly.

4. The latch assembly of claim 3, wherein the pin is formed from wear resistant steel and the meltable element is configured to melt at temperatures greater than about 400 degrees Celsius, present during fires, and prevent movement of the deadlock arm assembly.

5. A latch assembly for a fire door comprising:

a platform attached to the fire door;

an input wheel rotatably connected to the platform;

a latch bolt attached to the platform and extendible to engage a door frame and retractable to disengage from the door frame;

a linkage assembly coupled to the input wheel to extend and retract the latch bolt as the input wheel is rotated;

a deadlock arm assembly separate from the linkage assembly and pivotally attached to the platform for biased movement to a first position to block movement of the linkage assembly; and a fire fuse assembly attached to the linkage assembly to move the deadlock arm assembly out of its first position to block movement of the linkage assembly to a second position permitting movement of the linkage assembly and connected latch bolt, with the fire fuse assembly configured to melt at temperatures substantially above normal room temperature to prevent movement of the deadlock arm from said first position blocking linkage assembly movement to a second position allowing linkage assembly movement, the fire fuse assembly having a pin partially disposed within a meltable element, the meltable element connected to the input wheel for rotating movement of the pin and the meltable element with the input wheel at normal room temperatures, with the pin being positioned to engage and move the deadlock arm assembly from its first blocking position to its second position as the pin is rotated.

6. The latch assembly of claim 5, wherein the pin is formed from wear resistant steel and the meltable element is formed from low melt temperature zinc, with the zinc configured to melt at temperature of about 400 degrees Celsius.

* * * * *